US007833057B1

(12) United States Patent
Yang et al.

(10) Patent No.: US 7,833,057 B1
(45) Date of Patent: Nov. 16, 2010

(54) RECEPTACLE CONNECTOR

(75) Inventors: Chih-Lin Yang, Tu-Cheng (TW); Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 15 days.

(21) Appl. No.: 12/480,035

(22) Filed: Jun. 8, 2009

(51) Int. Cl.
*H01R 13/648* (2006.01)

(52) U.S. Cl. ..... 439/607.4

(58) Field of Classification Search . 439/607.31–607.4, 439/606.53, 607.54
See application file for complete search history.

(56) References Cited

U.S. PATENT DOCUMENTS

| | | | | |
|---|---|---|---|---|
| 5,017,156 | A * | 5/1991 | Sugiyama | 439/607.32 |
| 5,221,212 | A * | 6/1993 | Davis | 439/108 |
| 6,386,918 | B1 * | 5/2002 | Zheng et al. | 439/607.45 |
| 6,508,678 | B1 * | 1/2003 | Yang | 439/677 |
| 6,659,799 | B2 * | 12/2003 | Yang | 439/607.19 |
| 6,840,806 | B2 * | 1/2005 | Kodama | 439/607.24 |
| 6,884,116 | B2 * | 4/2005 | Suzuki et al. | 439/607.32 |
| 6,902,432 | B2 * | 6/2005 | Morikawa et al. | 439/607.41 |
| 7,029,318 | B2 * | 4/2006 | Yu | 439/488 |
| 7,165,989 | B2 * | 1/2007 | Huang et al. | 439/346 |
| 7,217,159 | B2 * | 5/2007 | Chung | 439/607.01 |
| 7,252,549 | B2 * | 8/2007 | Nishio et al. | 439/607.55 |
| 7,258,565 | B2 * | 8/2007 | Huang et al. | 439/353 |
| 7,331,822 | B2 * | 2/2008 | Chen n | 439/607.01 |
| 7,527,526 | B1 * | 5/2009 | Chen et al. | 439/607.01 |
| 7,753,729 | B2 * | 7/2010 | Wang | 439/607.01 |
| 7,771,235 | B2 * | 8/2010 | Kameyama | 439/607.27 |
| 2005/0277332 | A1 * | 12/2005 | Chen | 439/607 |
| 2006/0105630 | A1 * | 5/2006 | Zhang et al. | 439/607 |
| 2009/0023337 | A1 * | 1/2009 | Chang | 439/607 |
| 2010/0055979 | A1 * | 3/2010 | Wang et al. | 439/607.01 |

* cited by examiner

*Primary Examiner*—Neil Abrams

(57) ABSTRACT

A receptacle connector includes an insulating body having a base portion, and a shell enclosing the insulating body. Two opposite side surfaces of the base portion respectively define an inserting passage extending longitudinally and having a front end opened freely. A front of each inserting passage is provided with a preventing block. A fixing cavity is formed in a rear of the inserting passage by the partition of the preventing block. The preventing block has a guiding surface inclined outward from front to rear. The shell has two side boards against the corresponding side surfaces of the base portion. Two fixing portions are protruded inwardly from two substantially corresponding portions of two bottom edges of the side boards for gliding along the corresponding guiding surfaces in the respective inserting passages to buckle into the corresponding fixing cavities and then restrained by the preventing blocks in the fixing cavities.

5 Claims, 4 Drawing Sheets

RECEPTACLE CONNECTOR

BACKGROUND OF THE INVENTION

1. Field of the Invention

The present invention generally relates to a receptacle connector, and more particularly to a receptacle connector capable of facilitating an assembly thereof.

2. The Related Art

Referring to FIG. 6, a conventional receptacle connector 200 includes a shell 4, an insulating body 5 and a plurality of terminals 6 disposed in the insulating body 5. The shell 4 is substantially of rectangular ring shape by a front view and has a pair of side boards 41 facing each other. A rear of each of the side boards 41 is provided with a fixing portion 411, and two opposite sides of a rear of the insulating body 5 are accordingly provided with a pair of fixing gaps 51. The shell 4 encloses the insulating body 5 therein, and the fixing portions 411 are buckled into the corresponding fixing gaps 51 to secure the insulating body 5 in the shell 4. However, in process of assembling the receptacle connector 200, the fixing portions 411 of the shell 4 need to be further oppositely pulled apart from each other with an external tool so as to be buckled into the corresponding fixing gaps 51 of the insulating body 5 so that results in a relatively complicated assembly process. Furthermore, because of small structure of the fixing portion 411 and the fixing gap 51, it is difficult to rightly position the fixing portions 411 into the corresponding fixing gaps 51. As a result, the fixing portions 411 of the shell 4 are apt to scrape the insulating body 5 during assembling the receptacle connector 200. Therefore, a receptacle connector capable of overcoming the above problems is required.

SUMMARY OF THE INVENTION

It is an object of the present invention to provide a receptacle connector including an insulating body, a plurality of terminals received in the insulating body, and a shell enclosing the insulating body. The insulating body has a base portion of which two opposite side surfaces respectively define an inserting passage extending longitudinally and having a front end opened freely. A front of each of the inserting passages is provided with a preventing block therein. A fixing cavity is formed in a rear of the inserting passage by the partition of the preventing block. The preventing block has a preventing surface facing the fixing cavity and a guiding surface inclined outward from front to rear to connect to an outer edge of the preventing surface. The shell has two side boards respectively against the corresponding side surfaces of the base portion. A pair of fixing portions is protruded inwardly from two substantially corresponding portions of two bottom edges of the side boards for gliding along the corresponding guiding surfaces in the respective inserting passages to buckle into the corresponding fixing cavities and then restrained by the preventing surfaces of the corresponding preventing blocks in the respective fixing cavities.

As described above, the preventing block of the insulating body has the guiding surface to guide the fixing portion of the shell along the inserting passage to be buckled into the corresponding fixing cavity instead of an external tool so that facilitates the fixing portion to be rightly positioned in the fixing cavity and simplifies the assembly process of the receptacle connector. Furthermore, the fixing portion can be secured in the fixing cavity by the preventing block so that makes the insulating body firmly assembled in the shell to ensure the stability of the receptacle connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
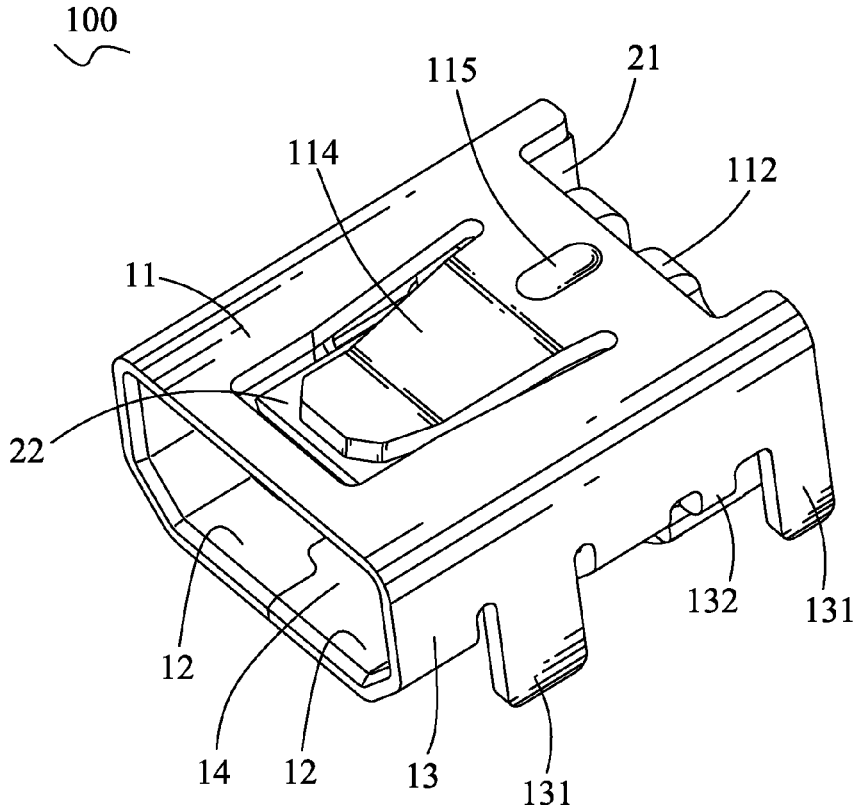
FIG. 1 is a perspective view of a receptacle connector in accordance with the present invention.
Figure 2:
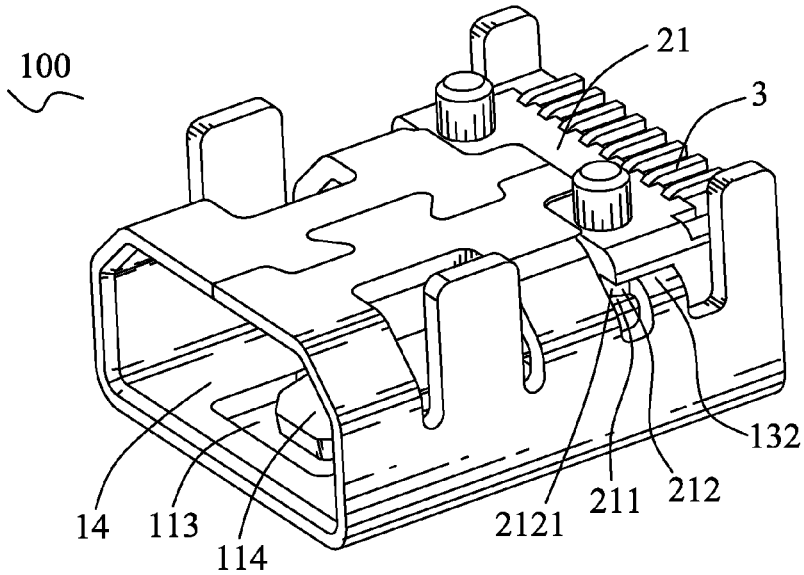
FIG. 2 is a perspective view of the receptacle connector of FIG. 1 viewed from another angle.
Figure 3:
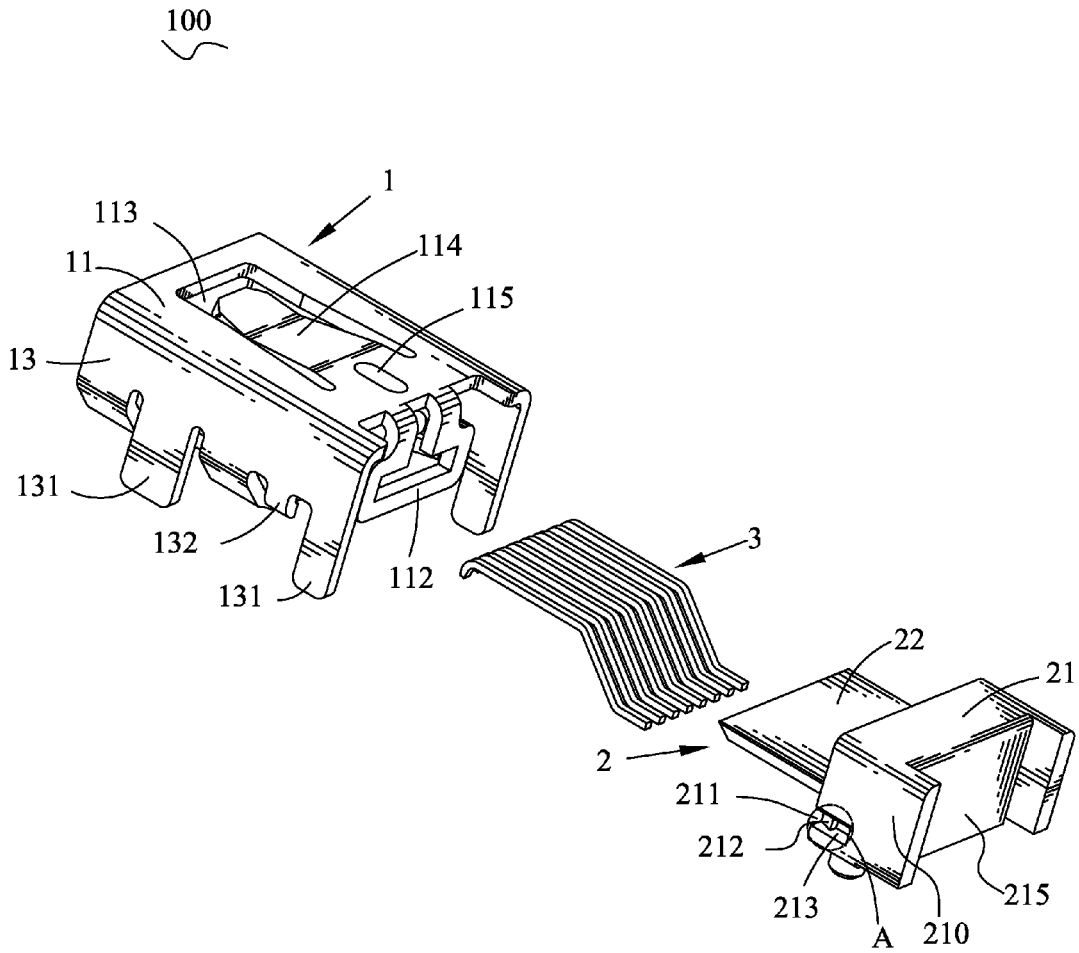
FIG. 3 is an exploded perspective view of the receptacle connector of FIG. 1.

Referring to FIGS. 1-3, a receptacle connector 100 according to the present invention includes a shell 1, an insulating body 2 engaged with the shell 1 and a plurality of terminals 3 integrated in the insulating body 2.

Figure 4:
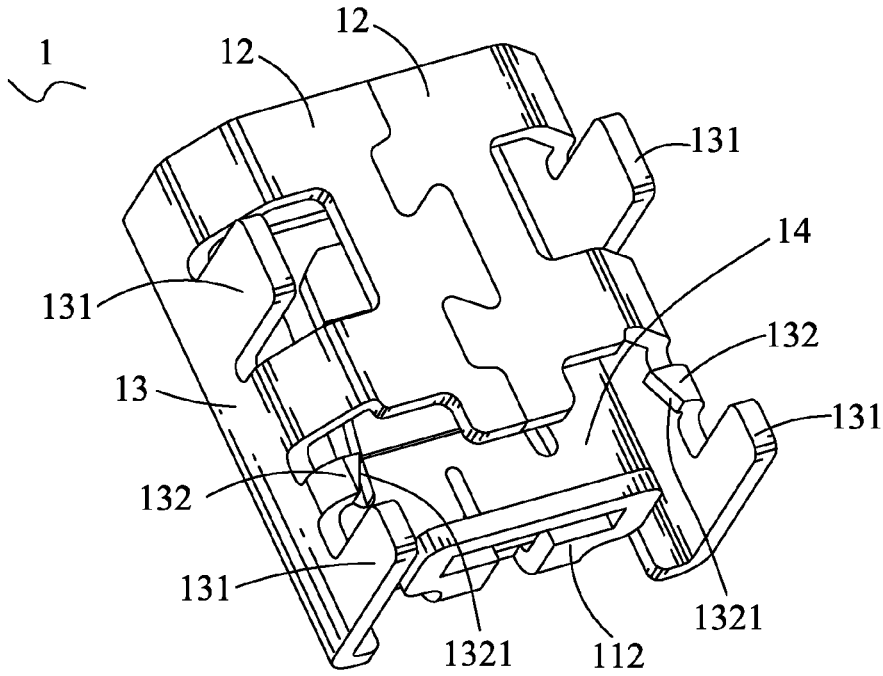
FIG. 4 is a perspective view of a shell of the receptacle connector of FIG. 2.

Referring to FIG. 3 and FIG. 4, the shell 1 has a flat rectangular top board 11. Two opposite side edges of the top board 11 extend downward to form a pair of side boards 13 facing each other. Two bottom edges of the pair of side boards 13 are bent and then horizontally extend toward each other to form a pair of bottom boards 12 engaged with each other. A receiving recess 14 is defined by the top board 11, the two side boards 13 and the two bottom boards 12. A middle of the top board 11 defines a substantially rectangular opening 113 penetrating therethrough to communicate with the receiving recess 14. A rear edge of the opening 113 extends forward and is slightly inclined downward into the receiving recess 14, and then is bent upward to form a resisting arm 114. A rib 115 is protruded upward across the junction of the resisting arm 114 and the top board 11 for strengthening the resisting arm 114 against an external mated plug connector (not shown). A rear edge of the top board 11 is provided with a preventing frame 112 facing the receiving recess 14. Each of the side boards 13 extends downward to form two soldering feet 131 spaced from each other, of which one is located at a rear end of the corresponding side board 13 and apart from a rear edge of the corresponding bottom board 12. The bottom edge of the rear end of each of the side boards 13 extends downward and then is bent into the receiving recess 14 to form a hook-shaped fixing portion 132 which is located between the rear soldering foot 131 and the rear edge of the corresponding bottom board 12 and has a first guiding surface 1321 at a distal edge thereof. The two first guiding surfaces 1321 of the fixing portions 132 are formed to face each other and inclined toward each other from rear to front.

Figure 5:
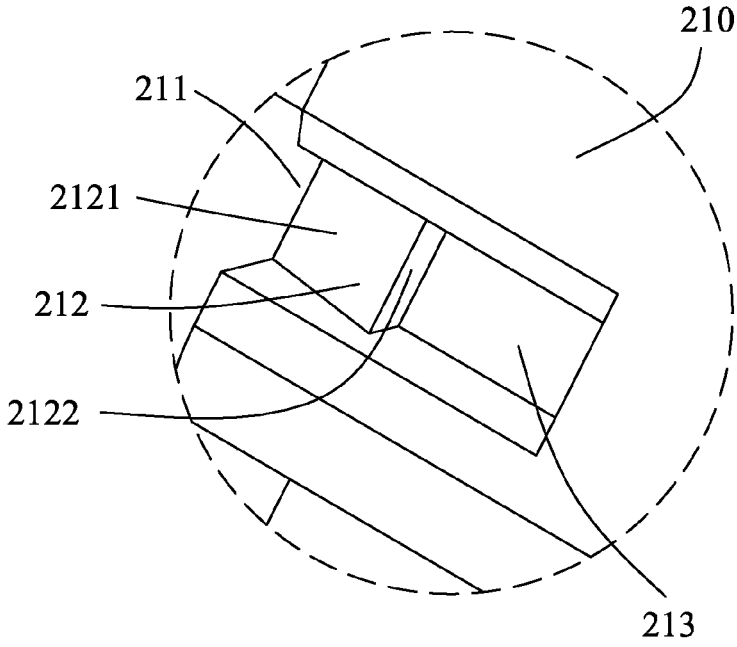
FIG. 5 is an enlarged view of an encircled portion A of an insulating body of the receptacle connector of FIG. 3.
Figure 6:
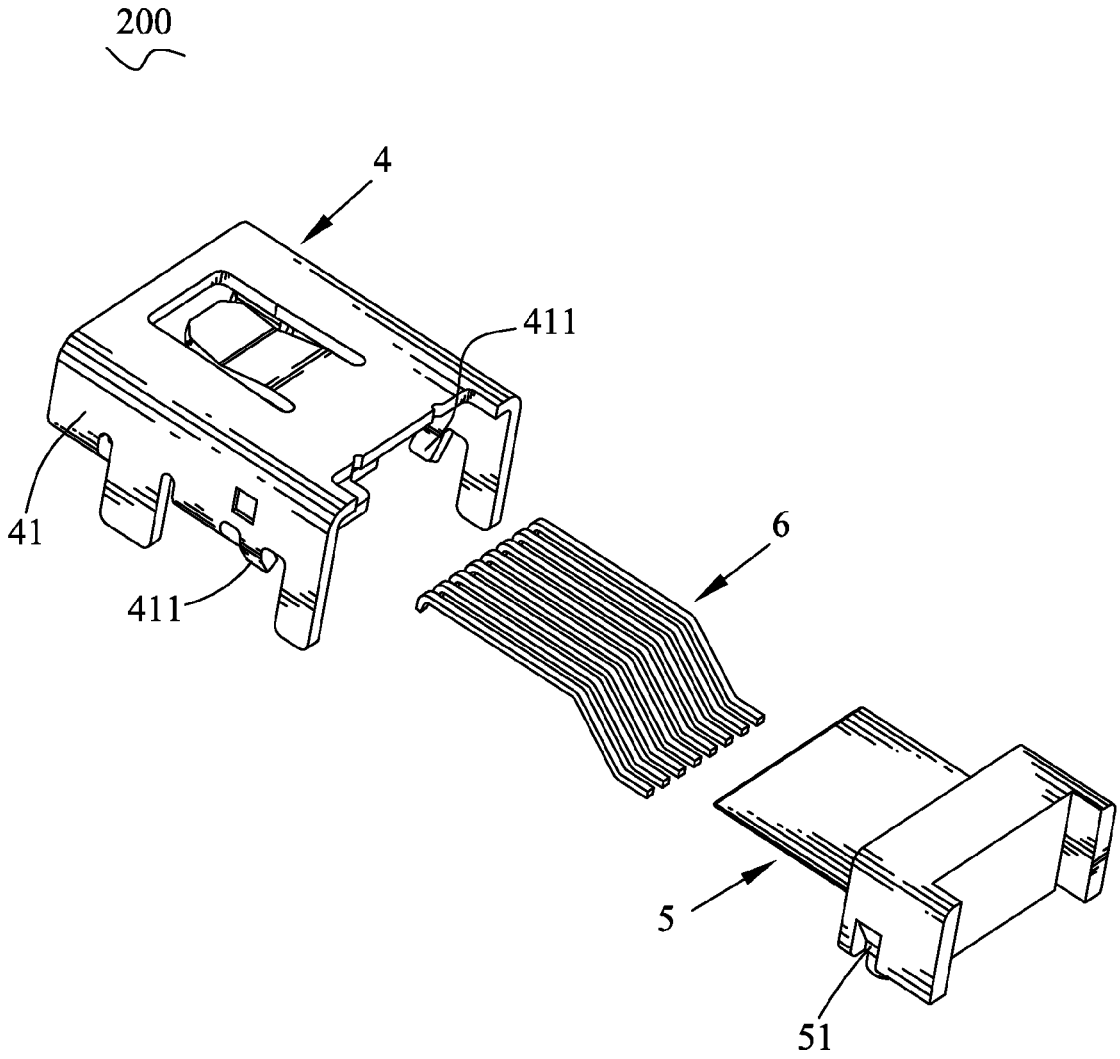
FIG. 6 is an exploded perspective view of a prior receptacle connector.

Referring to FIG. 3 and FIG. 5, the insulating body 2 has a substantially rectangular base portion 21 mated with a rear of the receiving recess 14 of the shell 1, and a tongue portion 22 extended forward from the base portion 21. A bottom of each of two opposite side surfaces 210 of the base portion 21 defines an inserting passage 211 extending longitudinally and having a front end opened freely. A front of each of the inserting passages 211 is provided with a preventing block 212 therein, and accordingly, a fixing cavity 213 is formed in a rear of the inserting passage 211 by the partition of the preventing block 212. The preventing block 212 defines a preventing surface 2122 facing the fixing cavity 213 and a second guiding surface 2121 inclined outward from front to rear to be connected with an outer edge of the preventing surface 2122. A rear surface of the base portion 21 opposite to the tongue portion 22 is provided with a receiving fillister 215 vertically passing therethrough.

Referring to FIGS. 1-5 again, in assembly, the insulating body 2 with the terminals 3 is inserted forward into the receiving recess 14 of the shell 1. The second guiding surfaces 2121 of the insulating body 2 are mated with respect to the corresponding first guiding surfaces 1321 of the shell 1 to guide the fixing portions 132 along the inserting passages 211 to be buckled into the respective fixing cavities 213 and then against the corresponding preventing surfaces 2122 so that the fixing portions 132 can be firmly secured in the respective fixing cavities 213 by the preventing blocks 212 so as to ensure a firm engagement of the insulating body 2 and the shell 1. Then the preventing frame 112 is located in the receiving fillister 215 by means of an external tool and against a front surface of the receiving fillister 215 so as to firmly restrain the insulating body 2 in the shell 1. The soldering feet 131 of the shell 1 are inserted into and soldered to a printed circuit board (not shown) for fixing the receptacle connector 100 on the printed circuit board.

As described above, the preventing block 212 of the insulating body 2 has the second guiding surface 2121 to guide the fixing portion 132 of the shell 1 to glide along the inserting passage 211 and then buckle into the corresponding fixing cavity 213 instead of an external tool so that facilitates the fixing portion 132 to be rightly positioned in the fixing cavity 213 and simplifies the assembly process of the receptacle connector 100. Furthermore, the fixing portion 132 can be secured in the fixing cavity 213 by the preventing block 212 so that makes the insulating body 2 firmly assembled in the shell 1 to ensure the stability of the receptacle connector 100.

What is claimed is:

1. A receptacle connector, comprising:

an insulating body having a base portion, two opposite side surfaces of the base portion respectively defining an inserting passage extending longitudinally and having a front end opened freely, a front of each of the inserting passages being provided with a preventing block therein, a fixing cavity being formed in a rear of the inserting passage by the partition of the preventing block, the preventing block having a preventing surface facing the fixing cavity and a guiding surface inclined outward from front to rear to connect to an outer edge of the preventing surface;

a plurality of terminals received in the insulating body; and a shell enclosing the insulating body and having two side boards respectively against the corresponding side surfaces of the base portion, a pair of fixing portions being protruded inwardly from two substantially corresponding portions of two bottom edges of the side boards for gliding along the corresponding guiding surfaces in the respective inserting passages to buckle into the corresponding fixing cavities and then restrained by the preventing surfaces of the corresponding preventing blocks in the respective fixing cavities.

2. The receptacle connector as claimed in claim 1, wherein each of the fixing portions is extended downward from the bottom edge of the corresponding side board and then is bent inwardly to show a hook-shape.

3. The receptacle connector as claimed in claim 2, wherein each of the fixing portions has a mated guiding surface with respect to the guiding surface of the corresponding preventing block at a distal edge thereof, the two guiding surfaces of the fixing portions are formed to face each other and inclined toward each other from rear to front.

4. The receptacle connector as claimed in claim 1, wherein the shell further has a top board defining an opening therein, a rear edge of the opening is provided with a resisting arm freely extended forward, a rib is protruded upward across the junction of the resisting arm and the top board for strengthening the resisting arm.

5. The receptacle connector as claimed in claim 1, wherein a rear surface of the base portion of the insulating body defines a receiving fillister, the shell further has a top board of which a rear edge is provided with a preventing frame located in the receiving fillister.

* * * * *